United States Patent [19]

Donnally

[11] Patent Number: 4,961,562

[45] Date of Patent: Oct. 9, 1990

[54] APPARATUS FOR ENGAGING BEAMS

[76] Inventor: Robert B. Donnally, 14806 Mesita, Houston, Tex. 77083

[21] Appl. No.: 272,720

[22] Filed: Nov. 16, 1988

[51] Int. Cl.[5] ..... B66F 1/00

[52] U.S. Cl. ..... 254/106

[58] Field of Search ..... 254/106, 107, 105, 108, 254/29 R, 30; 269/217, 203, 204

[56] References Cited

U.S. PATENT DOCUMENTS

| | | | |
|---|---|---|---|
| 3,033,525 | 5/1962 | Johnson . | |
| 3,373,971 | 3/1968 | Chambers et al. | 254/107 |
| 3,464,095 | 9/1969 | Chambers | 254/107 |
| 3,559,959 | 2/1971 | Chambers et al. . | |
| 3,941,353 | 3/1976 | Hack | 269/32 |
| 4,348,007 | 9/1982 | Malzacher | 254/106 |
| 4,572,481 | 2/1986 | Chambers | 254/106 |
| 4,657,438 | 4/1987 | Gillis . | |

FOREIGN PATENT DOCUMENTS

| | | |
|---|---|---|
| 0157073 | 9/1985 | European Pat. Off. . |
| 755970 | 8/1956 | United Kingdom . |
| 1201952 | 8/1970 | United Kingdom . |
| 1293163 | 10/1972 | United Kingdom . |
| 2003448 | 8/1977 | United Kingdom . |
| 1579484 | 11/1980 | United Kingdom . |

*Primary Examiner*—Robert C. Watson

*Attorney, Agent, or Firm*—David M. Ostfeld

[57] ABSTRACT

An improved apparatus and method for engaging beams is disclosed. A frame is positioned so that each end of the frame is adjacent to opposing surfaces of the beam. A shoe is located between one surface of the beam and the upper end of the frame, and a series of inclined plates are located between the shoe and the upper end of the frame. A hydraulic cylinder is operated to move the inclined plates, until the plates are perpendicular to the shoe, to cause the shoe and the lower end of the frame to engage the beam. Another hydraulic cylinder located between the frame and an object such as a drilling rig can be operated to move the object relative to the beam.

27 Claims, 3 Drawing Sheets

APPARATUS FOR ENGAGING BEAMS

FIELD OF THE INVENTION

The present invention relates to an improved apparatus and method for engaging beams. More particularly, the present invention relates to an apparatus for selectively engaging a beam and a method for selectively operating the apparatus.

BACKGROUND OF THE INVENTION

In the oil and gas industry, wells are drilled from offshore platforms located in water which may exceed one thousand feet in depth. To minimize the cost of producing oil and gas from a reservoir, drilling contractors typically drill a group of wells from a single platform. The wells can be "kicked out" from the base of the platform by using directional drilling techniques to reach locations in the underground reservoir at a distance from the base of the platform.

Each well is connected to a riser which extends from the sea floor to a deck of the offshore platform. Drilling rigs, which comprise a drilling derrick, a supporting structure, and drilling machinery, are used to drill the wellbore for each well. Once a wellbore has been drilled, the drilling rig must be moved to a new location on the deck of the platform so that a new well can be drilled. This process is repeated until all of the wells have been drilled from the platform. On large offshore platforms, dozens of wells may be drilled from the same platform deck.

The drilling rig and associated equipment is extremely heavy and is not easily transported from one well to another. Typically, the drilling rigs are supported on parallel beams known as "capping beams." The capping beams are fastened to the platform deck and are usually raised slightly above the platform deck. To move the drilling rig to a new location, the drilling rig is skidded along the capping beams by using large hydraulic cylinders which are anchored to the capping beams. In operation, one end of each hydraulic cylinder is anchored to a capping beam, and the hydraulic cylinders are simultaneously extended to their full stroke to move the drilling rig along the capping beams. The anchors are then disconnected, the cylinders are retracted, and the sequence is repeated until the drilling rig is located in the desired location.

Several types of devices are used to anchor the hydraulic cylinders to the capping beams. Claw type anchors positively engage the capping beams by using "dogs" or "claws" which are inserted into slots cut into the capping beams. "Grippers" are anchors which use a large clamping force to grip the capping beams. The clamping force must develop sufficient friction force between the gripper and the capping beam to prevent the anchor from slipping when the hydraulic cylinder is actuated to move the drilling rig.

Claw type anchors are less expensive than grippers when the capping beam is relatively short. On long capping beams, the cost increases with the number of slots which must be cut into the beam. For that reason, grippers are typically used for longer capping beams on platform decks which employ numerous wells. However, certain disadvantages are associated with gripper type anchors. For example, the frames of grippers must be sufficiently large to handle the bending loads produced by the clamping mechanism. Various types of grippers use hydraulic cylinders actuated wedge clamps, or hydraulic actuated lever clamps to generate the large clamping force necessary to hold the anchor. The frames necessary to hold these gripper type anchors are heavy and occupy scarce space on the deck of the offshore platform.

For these reasons, there is a need for an improved anchor which can selectively engage and disengage a beam such as a capping beam. On an offshore platform, the anchor should efficiently maximize the force engaging the beam to prevent movement of the anchor while the drilling rig is being moved.

SUMMARY OF THE INVENTION

The present invention provides an improved apparatus which can selectively engage a beam, and an improved method for anchoring the apparatus to the beam. The apparatus comprises a frame having ends on opposite sides of the beam. A shoe is located between one end of the frame and the beam, and at least one plate is located between the shoe and the end of the frames at an acute angle relative to the shoe. An actuator is capable of moving the plate to increase the acute angle between the plate and the shoe, thereby causing the shoe and the other end of the frame to engage the beam.

In other embodiments of the invention, a plurality of plates can be located between the frame and the shoe, pivot pins can be positioned at the end of each plate, and a brace can be connected to the frame to prevent rotation of the frame about the beam.

To practice the method of the invention, a hydraulic cylinder is placed between an object adjacent the beam and the frame of the apparatus. The actuator is operated to move the plate until the shoe and the frame engage the beam to anchor the apparatus to the beam. In other embodiments of the invention, the hydraulic cylinder can then be activated to move the object relative to the beam, the actuator can be operated to disengage the apparatus from the beam, and the hydraulic cylinder can be reoperated to move the frame relative to the beam.

DESCRIPTION OF THE PREFERRED EMBODIMENTS

Figure 1:
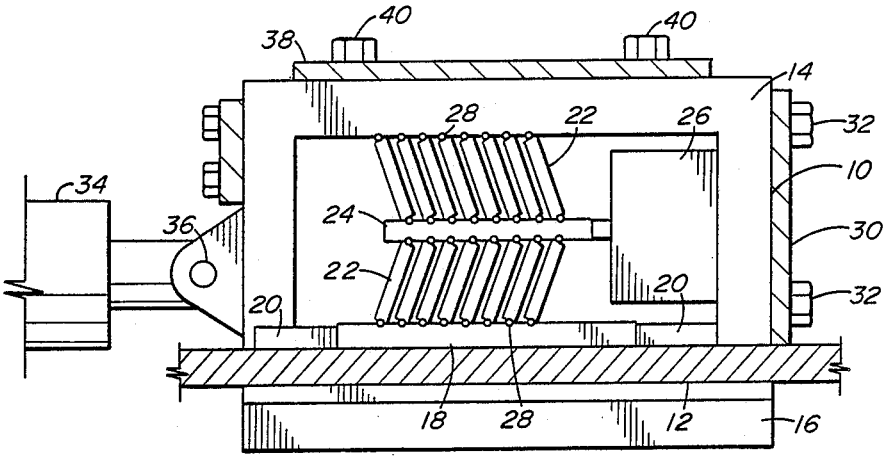
FIG. 1 illustrates an elevation view of the apparatus which shows the orientation of the inclined plates.

As shown in FIG. 1, the invention includes frame 10 which is located adjacent to a beam such as flanged beam 12. Frame 10 has a first end 14 which is shown above beam 12, and further has a second end 16 which is located below beam 12. Friction plate or shoe 18 is located adjacent the upper surface of beam 12 and is positioned by retaining clips 20 which retain shoe 18 within frame 10.

As illustrated, the lower surface of shoe 18 is adjacent beam 12, and the upper surface of shoe 18 faces toward the first end 14 of frame 10. At least one toggle link, illustrated as upper and lower jam plates 45, 22, respectively, is used. Lower jam plate 22 is positioned at an incline between the upper surface of shoe 18 and the lower surface of push rod 24. Upper jam plate 45 is positioned at an incline between the upper surface of push rod 24 and the first end 14 of frame 10. It is not necessary that the angle of the lower plate 22 with the push rod 24 be equal to the angle the upper plate 45 makes with push rod 24. It is also not necessary that the length of the lower plate 22 be equal to the length of the upper plate 45. Any combination of lengths and angles between the upper and lower plates 45, 22 can be used so long as the net result of a substantially horizontal movement of the push rod 24 results in engagement of the beam 12. Plates 22, 45 are elongated. The longitudinal axis of either plate 22, 45 or both plates 22, 45 are inclined with respect to push rod 24 at an acute angle less than ninety degrees. As shown in FIG. 1, two sets of plates 22, 45 are located above and below push rod 24, and push rod 24 is connected to actuator 26. In a preferred embodiment, pivot pins 28 are connected to each end of plates 22, 45. Actuator 26 can comprise a hydraulic cylinder or other type of device which can selectively react against frame 10 to move push rod 24 toward and away from frame 24 in a reciprocating fashion. Cover plate 30 is connected to frame 10 with bolts 32. Cover plate 30 is removable to permit the installation of actuator 26 within frame 10. Hydraulic cylinder 34 is connected to frame 10 with pin 36.

Figure 2:
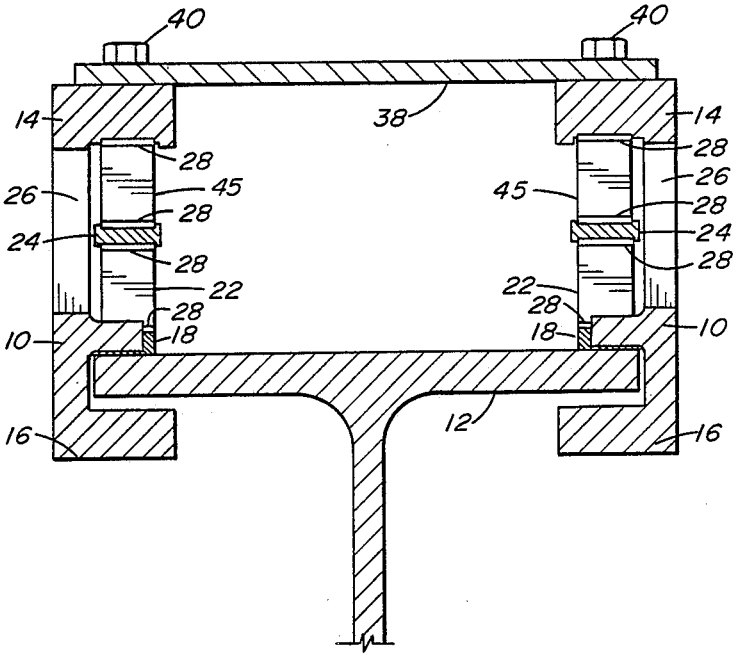
FIG. 2 illustrates a sectional view of the apparatus when the frame is not in engagement with the beam.

Referring to FIG. 2, two opposing frames 10 are located on each side of flanged beam 12. The first end 14 of each frame 10 is connected by brace 38 which is secured with bolts 40. Brace 38 positions frames 10 and prevents rotational movement of frames 10 about the longitudinal axis of beam 12. As is shown in FIG. 2, the second end 16 of frame 10 is not in contact with the flange of beam 12. In this position, frame 10 can be moved along beam 12. Frame 10 in cross section is generally in the shape of a c-clamp.

Figure 3:
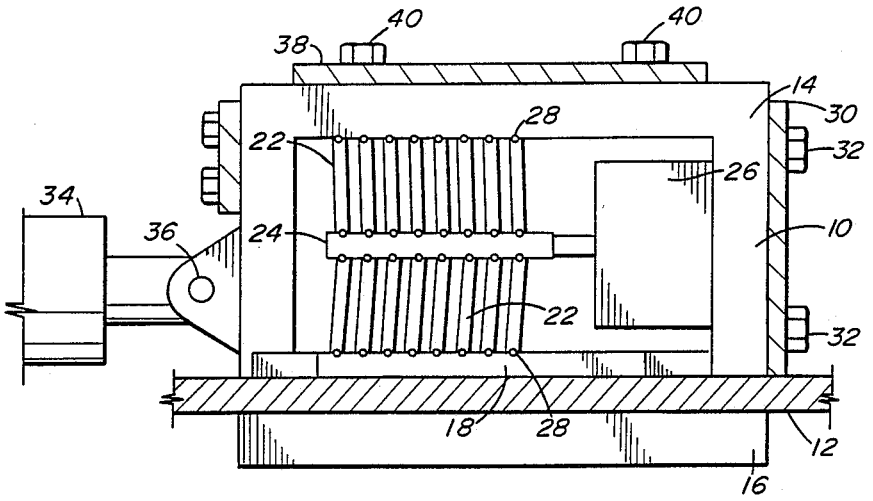
FIG. 3 illustrates an elevation view of the apparatus when the plates have been moved to engage the frame and shoe to one beam.
Figure 4:
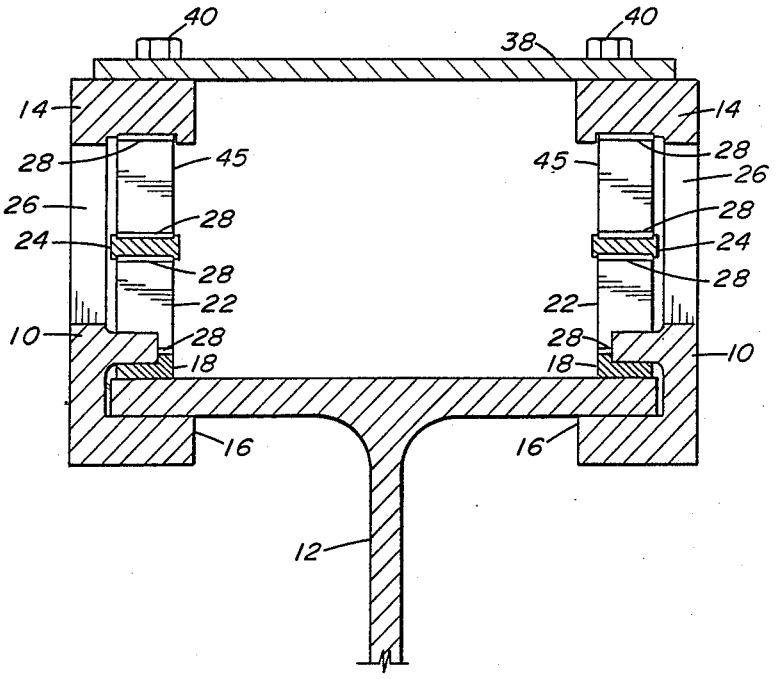
FIG. 4 illustrates a sectional view of the apparatus when the shoe and frame are engaged with the beam.

Referring to FIG. 3, the apparatus is shown in the engaged position. Actuator 26 and push rod 24 are operated to move plates 22, 45 to increase the acute angle between plates 22, 45 and push rod 24. As the acute angle increases, the effective length of plates 22, 45 between shoe 18 and the first end 14 of frame 10 is increased. As this occurs, plates 22, 45 push the first end 14 of frame 10 upward, which raises the second end 16 of frame 10 against beam 12, and simultaneously pushes shoe 18 downward against beam 12. As shown in FIG. 4, this position clamps the flanges of beam 12 between shoe 18 and the lower end 16 of frame 10, thereby anchoring frame 10 to beam 12.

Figure 5:
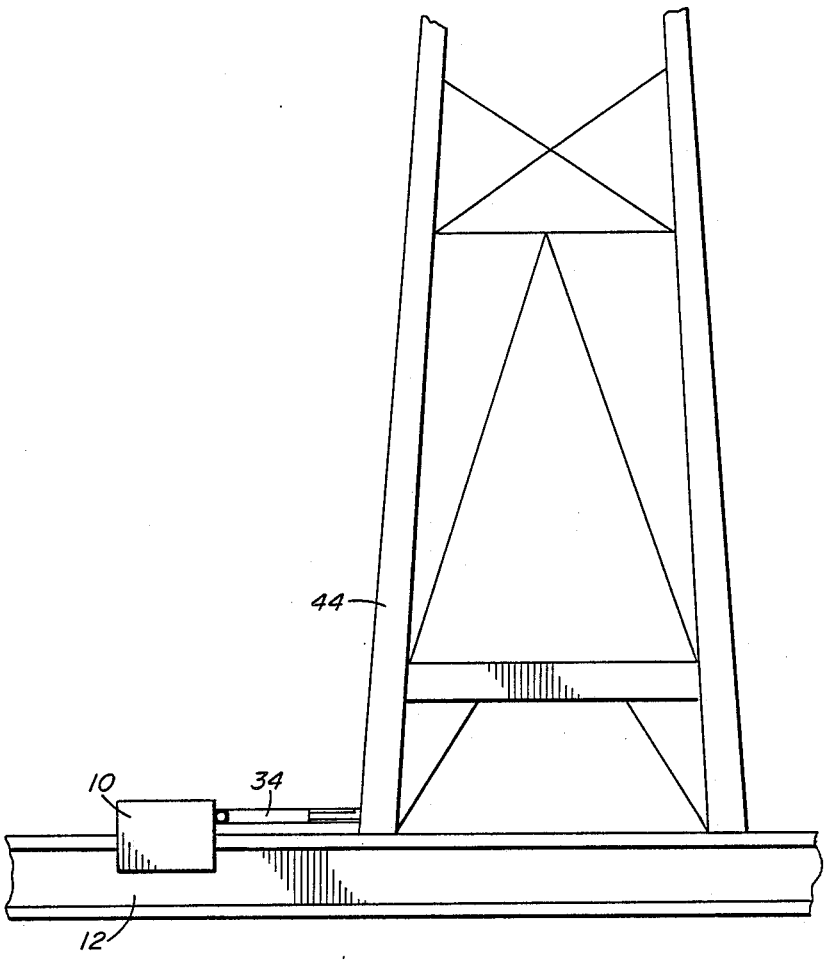
FIG. 5 illustrates an elevation view of the apparatus in operating position with the beam and a drilling rig.

Referring to FIG. 5, one embodiment of the present invention is shown. Beam 12 is located in a substantially horizontal position, and drilling rig 44 rests on beam 12. Frame 10 is adjacent to beam 12, and hydraulic cylinder 34 is connected between frame 10 and drilling rig 44.

To operate the invention, hydraulic cylinder 34 or similar force mechanism is placed between frame 10 and the object, shown as rig 44. Actuator 26 is operated to cause plates 22, 45 to expand as previously described. Plates 22, 45 cause shoe 18 and the second end 16 of frame 10 to engage beam 18, thereby anchoring frame 18 to beam 12. Rig 44 can then be moved relative to beam 12 by activating hydraulic cylinder 34 until the end of the stroke for hydraulic cylinder 34 has been reached. Next, actuator 26 can be operated to release shoe 18 and frame 10 from the engaged position, and frame 10 can then be moved relative to beam 12. This process can be repeated until rig 44 is located in the desired position along beam 12.

The present invention provides many unique advantages over the prior art. For example, plates 22, 45 and shoe 18 concentrate the clamping force on the preferred location on the flange of beam 12. Frame 10 is easy to manufacture and is configured to minimize the bending arm and correlative movements acting on Frame 10. This configuration minimizes the size and weight of the apparatus and thereby facilitates its handling.

The clamping mechanism is efficient because there are no bending loads acting on plates 22, 45, as plates 22, 45 and pivot pins 28 are held in compression. Friction loss is small due to the small radius of pivot pins 28. All of the clamping and linkage components are easy to manufacture, and the clamping force exerted by actuator 26 can be furnished by an efficient hydraulic cylinder. In various embodiments, pivot pins 28 can be removed without significantly affecting the operation of plates 22, 45 as illustrated.

Many modifications and improvements may be made to the apparatus and method disclosed herein without departing from the scope of the invention. For example, the disclosure shows only horizontal uses. However, this invention could operate at any angle including vertical. Also, rather than anchor actuator 26 to frame 10, it can be arranged to float within frame 10 and react against a second push rod and set of jam plates. The figures and examples set forth herein should be interpreted as illustrative and not in a limiting sense.

What is claimed is:

1. An apparatus for selectively engaging a beam applying high loads which has two opposing surfaces, comprising:

a frame having a first end which faces one side of the beam and having a second end adjacent to the other surface of the beam;

a shoe located between the beam and the first end of said frame, wherein said shoe has a flat surface adjacent to the beam whereby load is distributed over a substantial area of the beam and has a second surface facing the first end of said frame;

at least one plate located between said shoe and the first end of said frame, wherein said plate is inclined at an acute angle relative to the second surface of said shoe; and an actuator for moving said plate so that the acute angle between said plate and the second surface of said shoe increases and causes said shoe and the second end of said frame to engage the beam.

2. An apparatus as recited in claim 1, wherein said actuator is capable of moving said plate to reduce the angle between the plate and the second surface of said shoe.

3. An apparatus as recited in claim 1, wherein said actuator comprises a push rod and a hydraulic cylinder.

4. An apparatus as recited in claim 3, wherein said push rod is at least partially located between said plate and the first end of said frame.

5. An apparatus as recited in claim 4, further comprising at least one plate which is located between said push rod and the first end of said frame.

6. An apparatus as recited in claim 1, wherein said frame is c-shaped in cross-section.

7. An apparatus for selectively engaging a beam applying high loads which has two opposing surfaces, comprising:

a frame having a first end which faces one side of the beam and having a second end adjacent to the other surface of the beam;

a shoe located between the beam and the first end of said frame, wherein said shoe has a flat surface adjacent to the beam whereby load is distributed over a substantial area of the beam and has a second surface facing the first end of said frame;

at least one plate located between said shoe and the first end of said frame, wherein said plate is inclined at an acute angle relative to the second surface of said shoe;

an actuator for moving said plate so that the acute angle between said plate and the second surface of said shoe increases and causes said shoe and the second end of said frame to engage the beam; and further comprising pivot pins attached to the ends of said plate.

8. An apparatus as recited in claim 1, further comprising a brace for preventing rotation of said frame about the beam.

9. An apparatus as recited in claim 1, further comprising a hydraulic cylinder engaged with said frame for moving objects relative to said frame.

10. An apparatus for selectively engaging a beam applying high loads which has two opposing surfaces, comprising:

a frame having a first end which faces one side of the beam and having a second end adjacent to the other surface of the beam;

a shoe located between the beam and the first end of said frame, wherein said shoe has a flat surface adjacent to the beam whereby load is distributed over a substantial area of the beam and has a second surface facing the first end of said frame;

at least one plate located between said shoe and the first end of said frame, wherein said plate is inclined at an acute angle relative to the second surface of said shoe;

an actuator for moving said plate so that the acute angle between said plate and the second surface of said shoe increases and causes said shoe and the second end of said frame to engage the beam; and further comprising clips for retaining said shoe within said frame.

11. An apparatus for selectively engaging a beam applying high loads which has two opposing surfaces, comprising:

a frame having a first end which faces one side of the beam and having a second end adjacent to the other surface of the beam;

a shoe located between the beam and the first end of said frame, wherein said shoe has first surface adjacent to the beam and has a second surface facing the first end of said frame;

a push rod located between said shoe and the first end of said frame;

at least one first plate located at an angle between said push rod and said shoe;

at least one second plate located at an angle between said push rod and said frame; and an actuator for causing said push rod to move said first plate and said second plate so that the acute angle between said first plate and said shoe increases and so that the acute angle between said second plate and the first end of said frame increases until said shoe and the second end of said frame engage the beam.

12. An apparatus as recited in claim 11, further comprising pivot pins attached to the ends of said first plate and to the ends of said second plate.

13. An apparatus as recited in claim 11, wherein said actuator and said push rod are capable of moving said first plate and said second plate into a position perpendicular to the second surface of said shoe.

14. An apparatus as recited in claim 11, wherein said frame is c-shaped in cross-section.

15. An apparatus as recited in claim 11, further comprising a brace for preventing rotation of said frame about the beam.

16. An apparatus as recited in claim 11, wherein said actuator comprises a hydraulic cylinder.

17. An apparatus as recited in claim 11, further comprising a hydraulic cylinder engaged with said frame for selectively moving objects relative to said frame.

18. An apparatus for selectively engaging a flanged beam applying high loads, wherein the flange of the beam has a first surface and an opposite second surface, and for moving an object relative to said beam, comprising:

a frame having a first end which faces the first surface of the flange and having a second end adjacent the second surface of the flange;

a shoe located between the first surface of the beam and the first end of said frame, wherein said shoe has a first surface adjacent to the flange and has a second surface facing the first end of said frame;

a push rod located between said shoe and the first end of said frame;

a plurality of first plates located at an angle between said push rod and said shoe;

a plurality of second plates located at an angle between said push rod and said frame;

an actuator for causing said push rod to move said first plates and said second plates until the first surface of said shoe and the second end of said frame are engaged with the flange of said beam; and a hydraulic cylinder engaged with said frame for selectively moving the object relative to said frame.

19. An apparatus as recited in claim 18, further comprising pivot pins attached to the ends of said first plates and attached to the ends of said second plates.

20. An apparatus as recited in claim 18, wherein said actuator and said push rod are capable of moving said first plates and said second plates into a position close to perpendicular to the second surface of said shoe.

21. An apparatus as recited in claim 18, further comprising a brace for preventing rotation of said frame about the beam.

22. An apparatus as recited in claim 18, wherein said hydraulic cylinder is capable of moving the object away from said frame.

23. An apparatus as recited in claim 18, wherein said hydraulic cylinder is capable of moving the object toward said frame.

24. An apparatus as recited in claim 18, wherein said actuator is capable of causing said push rod to move said first plates and said second plates so that said shoe and the second end of said frame are disengaged from the flange of the beam.

25. An apparatus as recited in claim 11, wherein said plates can be of any length, wherein substantial horizontal movement of said push rod results in engagement of the beam.

26. An apparatus as recited in claim 25, wherein said plates are of unequal length.

27. An apparatus as recited in claim 11, wherein said angle for said first plate is not equal to said angle for said second plate.

* * * * *